US007490558B2

(12) United States Patent
Asbach et al.

(10) Patent No.: US 7,490,558 B2
(45) **Date of Patent: *Feb. 17, 2009**

(54) REMOVABLE TRAY INSERT AND TRAY SET

(75) Inventors: Ronald M. Asbach, Grand Island, NY (US); John F. Rhein, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 115 days.

This patent is subject to a terminal disclaimer.

(21) Appl. No.: 11/186,855

(22) Filed: Jul. 22, 2005

(65) Prior Publication Data

US 2005/0263038 A1 Dec. 1, 2005

Related U.S. Application Data

(63) Continuation of application No. 09/954,448, filed on Sep. 18, 2001, now Pat. No. 6,920,830.

(51) Int. Cl.
*A47B 85/00* (2006.01)

(52) U.S. Cl. ..... 108/26; 108/90; 297/148

(58) Field of Classification Search ..... 108/26, 108/90, 25; 297/148, 153
See application file for complete search history.

(56) References Cited

U.S. PATENT DOCUMENTS

| | | | |
|---|---|---|---|
| 848,391 | A | 3/1907 | Oliver |
| 1,056,337 | A | 3/1913 | Hurlbut |
| 1,135,269 | A | 4/1915 | Dudley |
| 1,147,191 | A | 7/1915 | Rundle |
| 1,178,894 | A | 4/1916 | Wilcox |
| 1,279,615 | A | 9/1918 | Van Meter |
| 1,428,916 | A | 9/1922 | Snideman |
| 1,557,636 | A | 10/1925 | Warner |
| 1,887,987 | A | 11/1932 | Beckerman |
| 1,983,138 | A | 12/1934 | Lehman |
| 2,240,602 | A | 5/1941 | Bartsch |
| 2,282,881 | A | 5/1942 | Ostrow |
| 2,301,673 | A | 11/1942 | Allen |
| 2,402,861 | A | 6/1946 | Winnick |
| 2,505,490 | A | 4/1950 | Greenbaum |
| 2,560,708 | A | 7/1951 | Titus |
| 2,667,207 | A | 1/1954 | Magyar |
| 2,672,182 | A | 3/1954 | Gwin et al. |
| 2,691,411 | A | 10/1954 | Thatcher |
| 2,709,904 | A | 6/1955 | Boughton |
| 2,724,429 | A | 11/1955 | Warner |
| 2,726,838 | A | 12/1955 | Ripley, Jr. |
| 2,762,161 | A | 9/1956 | Danielson |
| 2,799,324 | A | 7/1957 | Anderson |
| 2,826,469 | A | 3/1958 | Grant |
| 2,902,084 | A | 9/1959 | Stevens |
| 2,934,135 | A | 4/1960 | Lesh |

(Continued)

FOREIGN PATENT DOCUMENTS

| | | | |
|---|---|---|---|
| FR | 2557438 | A | 7/1985 |

(Continued)

*Primary Examiner*—José V Chen
(74) *Attorney, Agent, or Firm*—Cooley Godward Kronish LLP

(57) ABSTRACT

A tray insert is adapted to be coupled to a support. A tray set includes a tray insert and a base tray or support.

15 Claims, 9 Drawing Sheets

U.S. PATENT DOCUMENTS

| | | | |
|---|---|---|---|
| 2,935,122 | A | 5/1960 | Miller |
| 2,971,567 | A | 2/1961 | Kimmel |
| 3,014,307 | A | 12/1961 | Dupuis |
| 3,143,374 | A | 8/1964 | Carboni |
| 3,204,367 | A | 9/1965 | Stubbmann |
| 3,330,597 | A | 7/1967 | Lay et al. |
| 3,383,134 | A | 5/1968 | Webb et al. |
| 3,415,570 | A | 12/1968 | Mosley et al. |
| 3,425,744 | A | 2/1969 | Spector et al. |
| 3,475,052 | A | 10/1969 | Kaposi |
| 3,490,808 | A | 1/1970 | Siegel |
| 3,512,297 | A | 5/1970 | Malherbe et al. |
| 3,516,709 | A | 6/1970 | Nader |
| 3,635,522 | A | 1/1972 | Kerwit |
| 3,649,074 | A | 3/1972 | McDonald et al. |
| 3,698,594 | A | 10/1972 | Boehlert |
| 3,729,037 | A | 4/1973 | Dare et al. |
| D229,999 | S | 1/1974 | Blazey et al. |
| 3,877,603 | A | 4/1975 | Holz |
| 3,944,109 | A | 3/1976 | Holz |
| 4,082,349 | A | 4/1978 | Ballenger |
| 4,094,547 | A | 6/1978 | Zampino et al. |
| 4,105,247 | A | 8/1978 | Saint |
| 4,298,228 | A | 11/1981 | Zampino et al. |
| 4,427,391 | A | 1/1984 | Berman |
| 4,512,607 | A | 4/1985 | Rapp |
| 4,582,359 | A | 4/1986 | Wise et al. |
| D283,956 | S | 5/1986 | Lemmeyer |
| 4,606,576 | A | 8/1986 | Jones |
| 4,634,185 | A | 1/1987 | Kassai |
| 4,640,033 | A | 2/1987 | Bulger |
| 4,723,813 | A | 2/1988 | Kassai |
| 4,807,928 | A | 2/1989 | Cone |
| 4,842,331 | A | 6/1989 | Waples |
| 4,844,537 | A | 7/1989 | Reed |
| 4,938,603 | A | 7/1990 | Turner et al. |
| 4,968,092 | A | 11/1990 | Giambrone |
| 5,071,149 | A | 12/1991 | Perego |
| 5,087,097 | A | 2/1992 | Hehn |
| D326,123 | S | 5/1992 | Connon |
| 5,118,161 | A | 6/1992 | Slowe et al. |
| 5,131,719 | A | 7/1992 | Kassai |
| D328,624 | S | 8/1992 | Hu |
| 5,165,755 | A | 11/1992 | Rho |
| 5,170,720 | A | 12/1992 | Scheurer |
| D333,060 | S | 2/1993 | Perego |
| 5,183,311 | A | 2/1993 | Meeker et al. |
| 5,238,292 | A | 8/1993 | Golenz et al. |
| D339,772 | S | 9/1993 | Hu |
| 5,254,007 | A | 10/1993 | Eagan |
| 5,294,172 | A | 3/1994 | Dubus |
| 5,332,241 | A | 7/1994 | Rho |
| 5,346,279 | A | 9/1994 | Pecorella |
| 5,348,368 | A | 9/1994 | Garcia et al. |
| 5,348,374 | A | 9/1994 | Kuo |
| 5,368,183 | A | 11/1994 | Singer |
| D356,531 | S | 3/1995 | Valenti |
| D358,730 | S | 5/1995 | Meeker et al. |
| 5,468,043 | A | 11/1995 | Chien |
| 5,468,051 | A | 11/1995 | Huang |
| D364,746 | S | 12/1995 | Lerner et al. |
| D364,896 | S | 12/1995 | Wu |
| 5,489,138 | A | 2/1996 | Mariol et al. |
| 5,507,550 | A | 4/1996 | Maloney |
| 5,509,719 | A | 4/1996 | Cone, II |
| 5,527,090 | A | 6/1996 | Cone, II |
| 5,538,432 | A | 7/1996 | Dondero et al. |
| 5,558,391 | A | 9/1996 | Chavous |
| D374,125 | S | 10/1996 | Bernstein et al. |
| 5,560,653 | A | 10/1996 | Beppu |
| 5,586,800 | A | 12/1996 | Triplett |
| 5,590,939 | A | 1/1997 | Piontek |
| 5,660,432 | A | 8/1997 | Davis |
| D383,338 | S | 9/1997 | Gibbs |
| 5,662,378 | A | 9/1997 | Carruth |
| 5,709,582 | A | 1/1998 | O'Donnell |
| 5,720,226 | A | 2/1998 | Padovano |
| 5,810,432 | A | 9/1998 | Haut et al. |
| 5,820,207 | A | 10/1998 | Wang |
| 5,823,615 | A | 10/1998 | Haut |
| 5,829,826 | A | 11/1998 | Ziccardi |
| D402,931 | S | 12/1998 | Huang |
| D409,026 | S | 5/1999 | Rosko et al. |
| 5,951,102 | A | 9/1999 | Poulson et al. |
| 5,975,628 | A | 11/1999 | Russell |
| 5,992,932 | A | 11/1999 | Kain et al. |
| 6,022,277 | A | 2/2000 | Jankowski |
| 6,033,019 | A | 3/2000 | Hession-Kunz et al. |
| 6,050,643 | A | 4/2000 | Kain et al. |
| D427,822 | S | 7/2000 | Greger |
| 6,082,814 | A | 7/2000 | Celestina-Krevh et al. |
| 6,089,653 | A | 7/2000 | Hotaling et al. |
| 6,119,996 | A | 9/2000 | Connery |
| 6,126,236 | A | 10/2000 | Wu |
| 6,179,377 | B1 | 1/2001 | Harper |
| 6,216,605 | B1 | 4/2001 | Chapman |
| D447,445 | S | 9/2001 | Lu |
| 6,298,793 | B1 | 10/2001 | Turner et al. |
| 6,302,033 | B1 | 10/2001 | Roudebush |
| 6,305,299 | B1 | 10/2001 | Ragland |
| 6,349,654 | B1 | 2/2002 | Peters |
| 6,421,901 | B2 | 7/2002 | Sitarski et al. |
| 6,497,452 | B2 | 12/2002 | Catelli |
| 6,578,496 | B2 | 6/2003 | Guard et al. |
| 6,920,830 | B1 * | 7/2005 | Asbach et al. ..... 108/26 |
| 2001/0035112 | A1 | 11/2001 | Guard et al. |

FOREIGN PATENT DOCUMENTS

| | | |
|---|---|---|
| FR | 2 589 706 A1 | 11/1985 |
| GB | 1 268 063 | 3/1972 |
| GB | 2 121 270 A | 12/1983 |
| WO | WO 93/14673 | 8/1993 |

* cited by examiner

REMOVABLE TRAY INSERT AND TRAY SET

CROSS REFERENCE TO RELATED APPLICATIONS

This application is a Continuation of U.S. application Ser. No. 09/954,448, filed Sep. 18, 2001 now U.S. Pat. No. 6,920, 830, the entire content of which is hereby incorporated by reference.

BACKGROUND

1. Field of the Invention

The present invention relates generally to a removable tray insert, and more particularly, to a tray insert that can be releasably coupled to a support or another tray.

2. Discussion of Related Art

Conventional trays generally include an edge flange surrounding a top surface upon which food and beverages can be placed. Food and beverage containers can be overturned easily and the contents spilled on the top surface of the tray, thereby requiring cleaning of the top surface of the tray.

In some conventional applications, a detachable container or material can be placed on a base tray to provide a removable surface that can be separated from the base tray to be cleaned.

Several conventional trays are complex and cumbersome. Moreover, the securing of a conventional detachable container or material to a base tray can be complicated. A need exists for a removable tray insert that can be easily coupled to a base tray or other support. A need also exists for a removable tray insert that can be easily cleaned, such as in a dishwasher.

SUMMARY OF THE INVENTION

The present invention solves the problems with, and overcomes the disadvantages of, conventional trays. In particular, the present invention provides a simple design that can be easily coupled to a base tray or other support. The invention includes a tray insert that is configured to releasably engage the tray insert within a recess of a support. In an alternative embodiment, the invention includes a tray set that includes a tray insert and a base tray or support.

DETAILED DESCRIPTION

A tray insert or liner includes a body portion and a coupler. In one embodiment, the body portion includes a pocket formed therein. In an alternative embodiment, the body portion includes a plurality of pockets formed therein. The plurality of pockets may be various sizes to accommodate different sizes or amounts of food, different sized containers, etc.

In one embodiment, the tray insert is releasably coupleable to a support, such as a base tray. The tray insert is disposable within a recess of the support. In one embodiment, the support includes a rim that defines a perimeter of the support and extends around a cavity formed in the support.

In one embodiment, the liner includes an outer portion that is releasably engageable with a rim of the support. The outer portion of the liner has substantially the same configuration as the contoured shape of a cavity in the support.

The tray insert can be placed in and coupled to a support to cover and protect the support during various activities, such as eating. The tray insert can be easily cleaned in a dishwasher.

Figure 1:
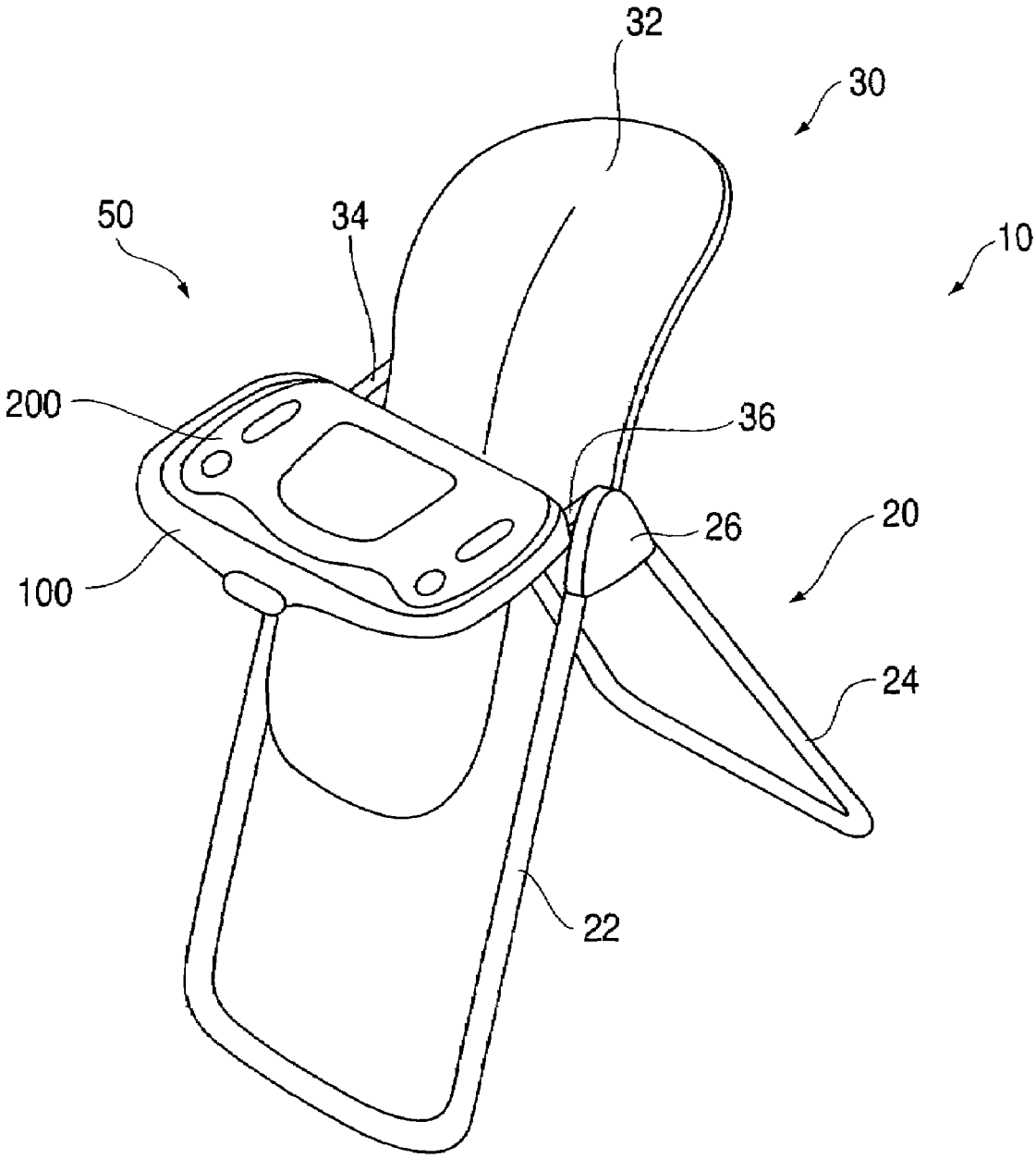
FIG. 1 is a perspective view of an embodiment of a child support structure according to an embodiment of the invention.

A support structure 10 according to an embodiment of the invention is illustrated in FIG. 1. FIG. 1 illustrates a schematic view of an exemplary support structure 10. Support structure 10 may be any type of support structure for children or adults, including seats, chairs, wheelchairs, swings, beds, etc.

In the illustrated embodiment, support structure 10 is a high chair for children. Support structure 10 includes a frame 20 and a seat portion 30 coupled to the frame 20. Frame 20 includes a front leg frame 22 and a rear leg frame 24 that are connected at their top ends by housings 26. Seat portion 30 includes a seat 32 with arm portions 34 and 36.

In the illustrated embodiment, the support structure 10 includes a tray set or combination 50. The tray set 50 includes a base tray or support 100 and a removable tray or tray insert or liner 200.

Figure 2:
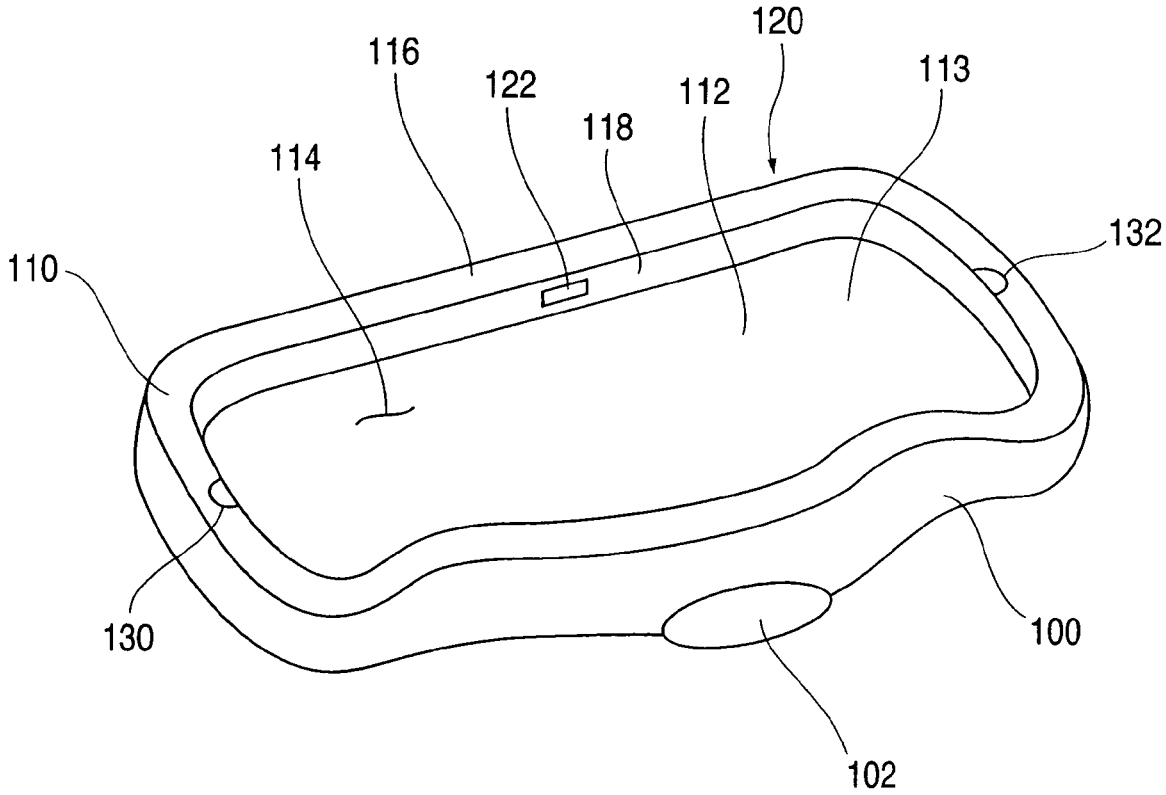
FIG. 2 is a perspective view of an embodiment of a base tray according to an embodiment of the invention.
Figure 3:
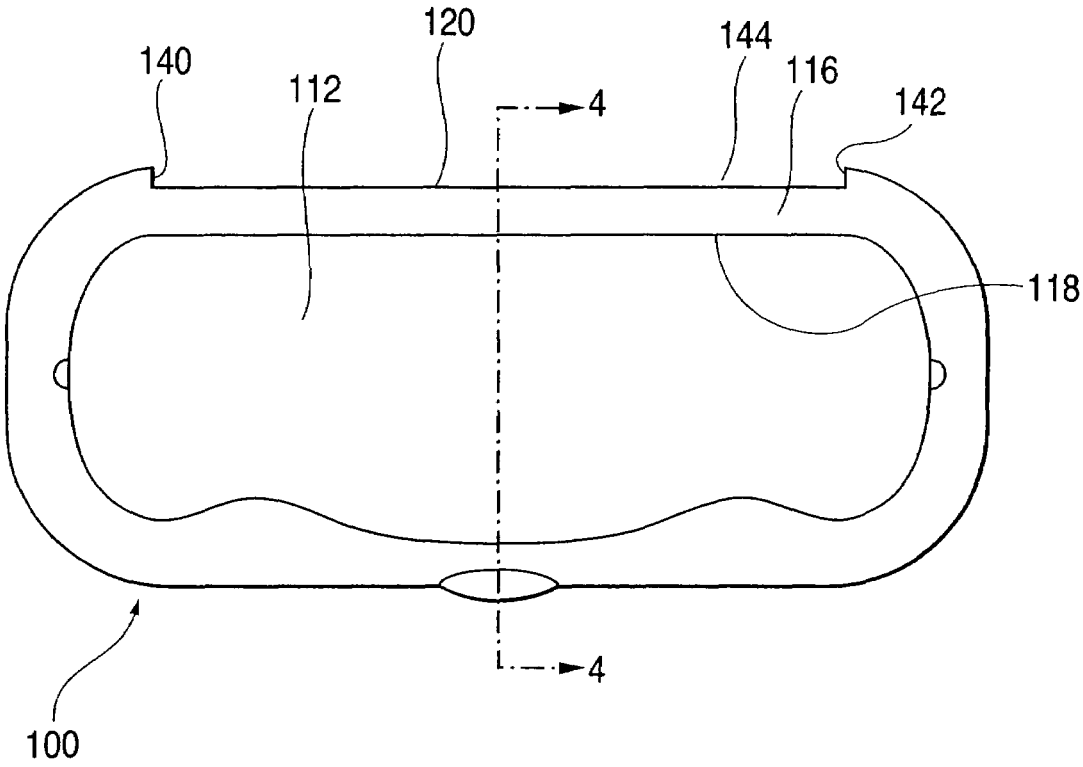
FIG. 3 is a top view of the base tray of FIG. 2.
Figure 4:
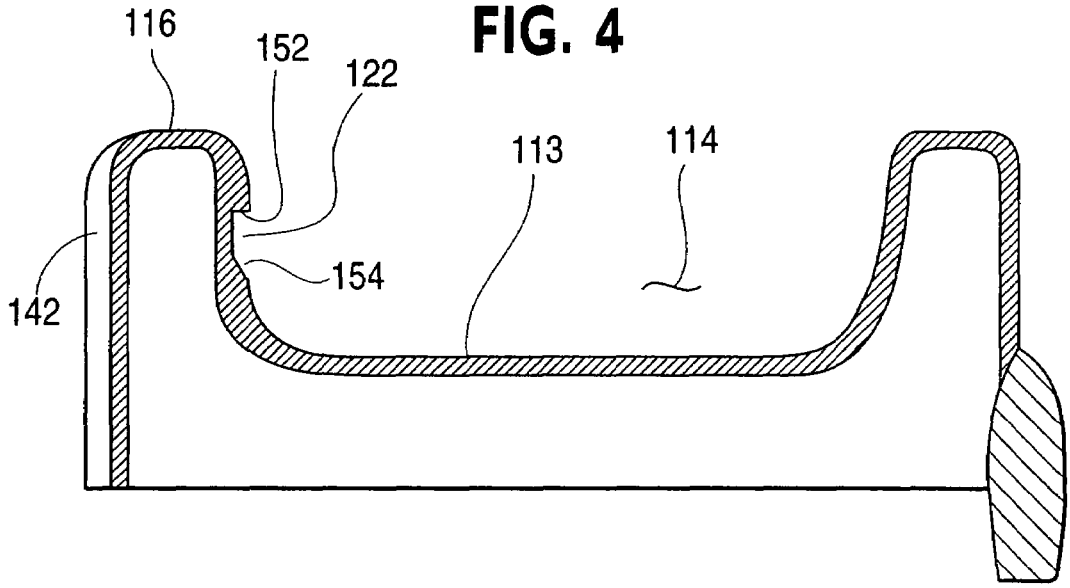
FIG. 4 is a cross-sectional side view of the base tray of FIG. 2 taken along lines "4-4" in FIG. 3.

A base tray according to an embodiment of the invention is illustrated in FIGS. 2-4. FIG. 2 illustrates a perspective view of base tray 100.

In the illustrated embodiment, base tray 100 includes a body portion 112 and a rim, ridge, or outer sidewall 110. As illustrated, ridge or rim 110 extends around the perimeter of body portion 112. The base tray 100 includes a contoured interior region or cavity 114. Cavity 114 is bounded by a lower surface 113 and rim or ridge 110. In the illustrated embodiment, ridge or rim 110 includes a rear wall 116 that has an inner surface 118 and an outer surface 120 as shown in FIG. 3.

As illustrated in FIG. 2, cavity 114 is one continuous surface area or region. However, cavity 114 could include several smaller cavities with varying sizes and depths to accommodate various articles, such as food, toys, etc. Cavity 114 may also be referred to as an interior region, a recess, or a pocket.

Tray 100 is formed in a generally planar configuration. However, tray 100 may have any desired contour.

In the illustrated embodiment, base tray 100 includes an actuator 102 that is operably coupled to a tray securing mechanism (not shown) coupled to the bottom surface of the base tray 100. The tray securing mechanism may be any conventional mechanism that enables the tray 100 to be secured to and released from the arm portions 34 and 36 of the seat portion 30 or any other part of the support structure 10.

In the illustrated embodiment, base tray 100 includes a recess 122 formed in the inner surface 118 of the rear wall 116 as illustrated in FIG. 2. Recess 122 is utilized to releasably couple tray insert 200 to the base tray 100 as described in greater detail below. In alternative embodiments, recess 122 can be formed in the outer surface 120 of the rear wall 116 or on the lower surface 113 of cavity 114. In further alternative embodiments, recess 122 can be formed at any location on or around inner surface 118 (front, rear, or sides) or outer surface 120 if tray insert 200 overlays a portion of outer surface 120.

In the illustrated embodiment, base tray 100 includes recesses 130 and 132 formed in rim 110. Recesses 130 and 132 can be used to facilitate the removal of tray insert 200 from base tray 100 by, for example, inserting a finger into the recesses 130 and 132 and pulling up on tray insert 200. While two recesses 130 and 132 are illustrated on opposite sides of cavity 114, any number of recesses may be provided at any location along rim 110.

Referring to FIG. 3, tray 100 includes a channel 144 formed along an outer side of the tray 100. In the illustrated embodiment, channel 144 extends between shoulders 140 and 142. Channel 144 is sized to receive a portion of tray insert 200 when the tray insert 200 is mounted on the tray 100.

As best seen in FIG. 4, recess 122 is defined by a shoulder 152 and a tapered surface 154. In alternative embodiments, recess 122 may be any structure or have any shape that enables the tray insert 200 to be coupled to the base tray 100.

Figure 5:
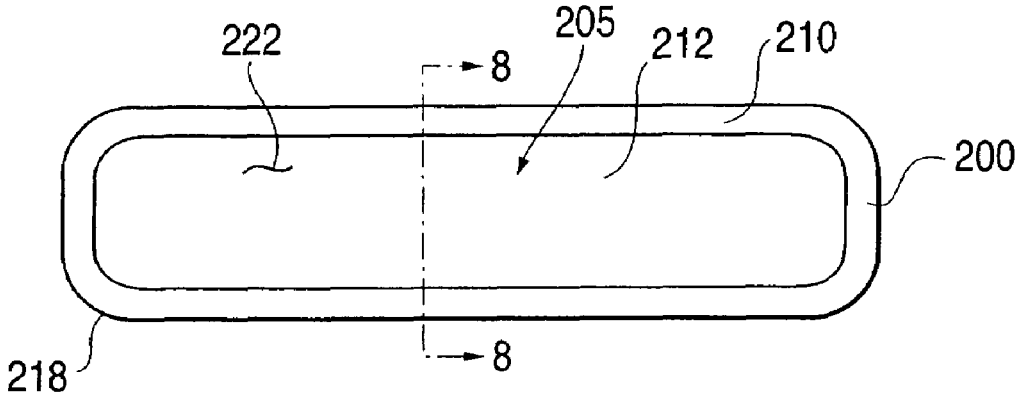
FIG. 5 is a top view of a liner according to an embodiment of the invention.
Figure 6:
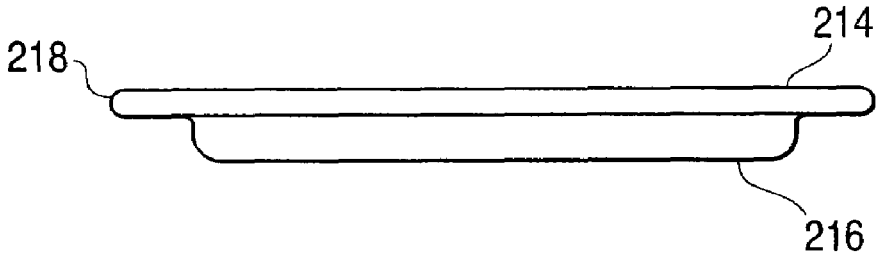
FIG. 6 is a front view of the liner of FIG. 5.

A tray insert or liner according to an embodiment of the invention is illustrated in FIGS. 5-9. FIG. 5 illustrates a top view of tray insert 200. Tray insert 200 may also be referred to as an insert, a liner, a portable tray, and a detachable tray.

In the illustrated embodiment, tray insert 200 includes a body portion 205 and an outer portion 210 extending around the body portion 205. The body portion 205 and outer portion 210 have a first or upper surface 214 and a second or lower surface 216. In the illustrated embodiment, the lower surface 216 of tray 200 has a similar configuration as the lower surface 113 of the cavity 114 formed in tray 100. In alternative embodiments, lower surface 216 may have any configuration that enables the tray insert 200 to be coupled to the base tray 100.

The body portion 205 includes a cavity 222. Cavity 222 is defined by bottom surface 212 and the outer portion 210, which extends around the cavity 222. Cavity 222 may also be referred to as a pocket, well, recess, or interior region. Cavity 222 can be sized to retain various articles therein and can be divided into several cavities of various sizes.

Figure 7:
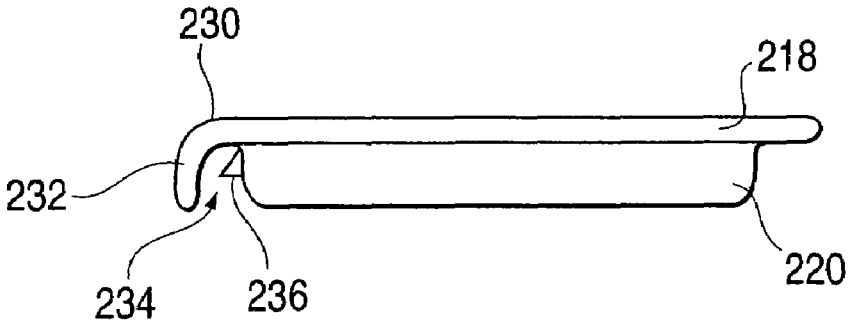
FIG. 7 is a side view of the liner of FIG. 5.
Figure 8:
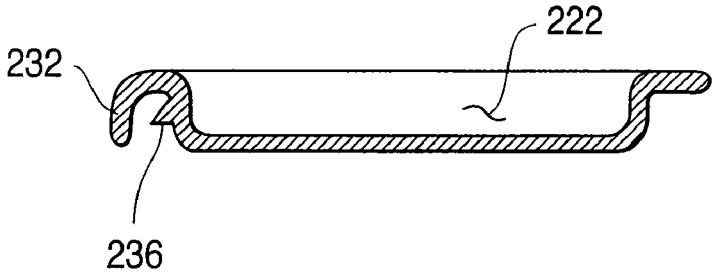
FIG. 8 is a cross-sectional side view of the liner of FIG. 5 taken along the lines "8-8" in FIG. 5.

As best seen in FIGS. 7 and 8, tray insert 200 includes an extending, engagement, or side portion 230 that extends from the rear of the body portion 205 of the tray insert 200. The extending portion 230 includes a flange 232 that extends downwardly from the extending portion 230 and forms a channel 234 with the body portion 205 of the tray insert 200. In the illustrated embodiment, flange 232 is a resilient or flexible member that can move relative to the body portion 205, thereby facilitating coupling and de-coupling of the tray insert 200 and the tray 100. In the illustrated embodiment, channel 234 is substantially U-shaped. However, channel 234 can have any configuration that facilitates the coupling of the tray insert 200 to the base tray 100.

In the illustrated embodiment, the tray insert 200 includes a coupler or coupling member 236. Coupler 236 is a protrusion or tab that extends from the bottom surface of the tray insert 200. Coupler 236 engages the recess 122 formed on the rear wall 116 of the base tray 100.

In one embodiment, coupler 236 is integrally formed on the bottom surface 216 of the tray insert 200. In an alternative embodiment, coupler 236 can be formed separate from the tray insert 200 and secured thereto using any conventional mechanism.

In the illustrated embodiment, the tray insert 200 includes a perimeter 218 that defines a contour for tray insert 200 that conforms to the contour of the cavity 114 formed in the base tray 100. In one embodiment, tray insert 200 covers substantially all of the cavity 114.

Figure 9:
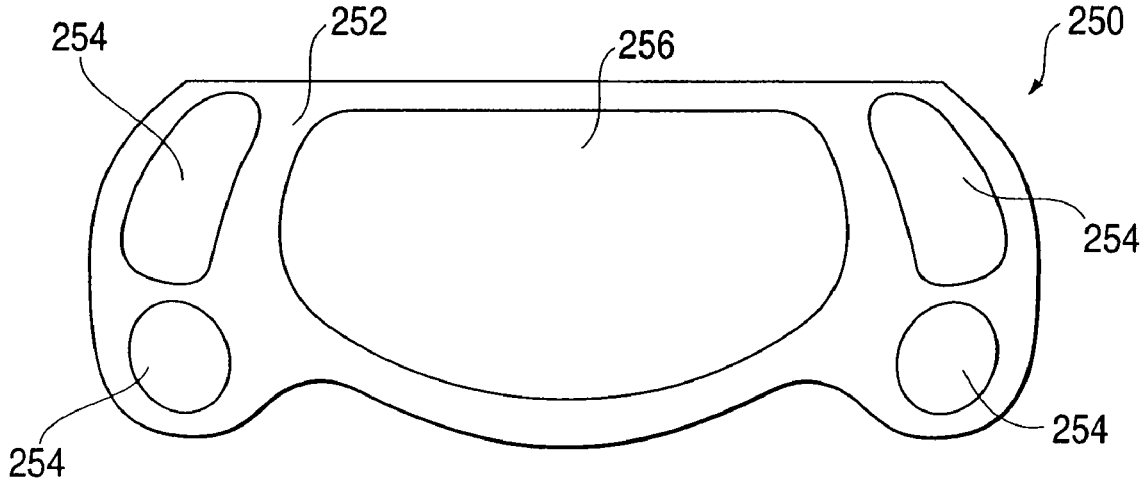
FIG. 9 is a top view of an alternative embodiment of a liner according to the invention.

An alternative embodiment of a tray insert according to the invention is illustrated in FIG. 9. Tray insert 250 includes a body portion 252 having a central large pocket or cavity 256 and several smaller pockets or cavities 254. The sizes and number of cavities 254 and 256 can vary depending on the desired configuration of the tray insert 200.

Figure 10:
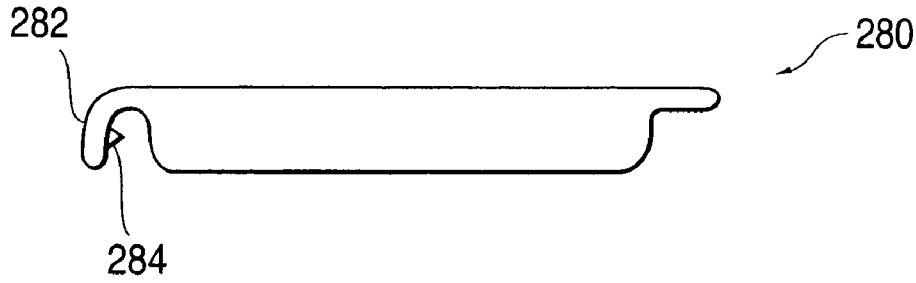
FIG. 10 is a side view of an alternative embodiment a liner according to the invention.

An alternative embodiment of a tray insert according to the invention is illustrated in FIG. 10. In this embodiment, tray insert 280 includes a coupler 284 disposed on a portion of flange 282. In this arrangement, coupler 284 is positioned to engage a corresponding recess located on the outer surface of a base tray.

Figure 11:
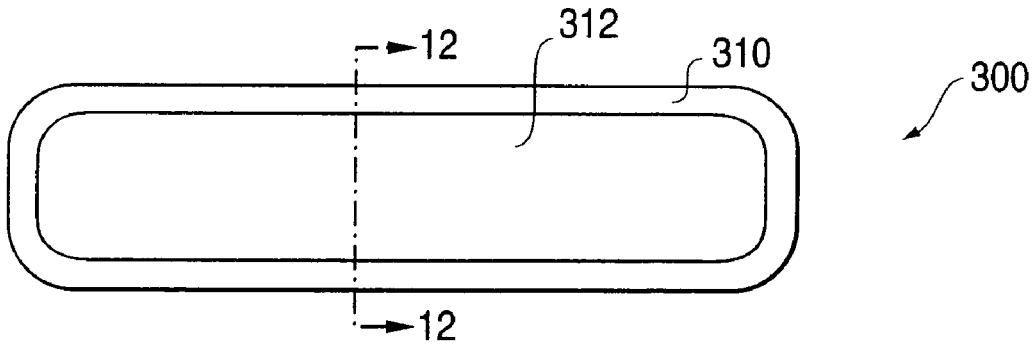
FIG. 11 is a top view of an alternative embodiment a liner according to the invention.
Figure 12:
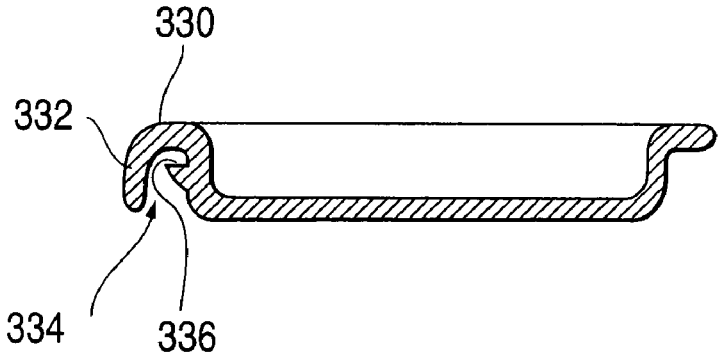
FIG. 12 is a cross-sectional side view of the liner of FIG. 11 taken along the lines "12-12" in FIG. 11.
Figure 13:
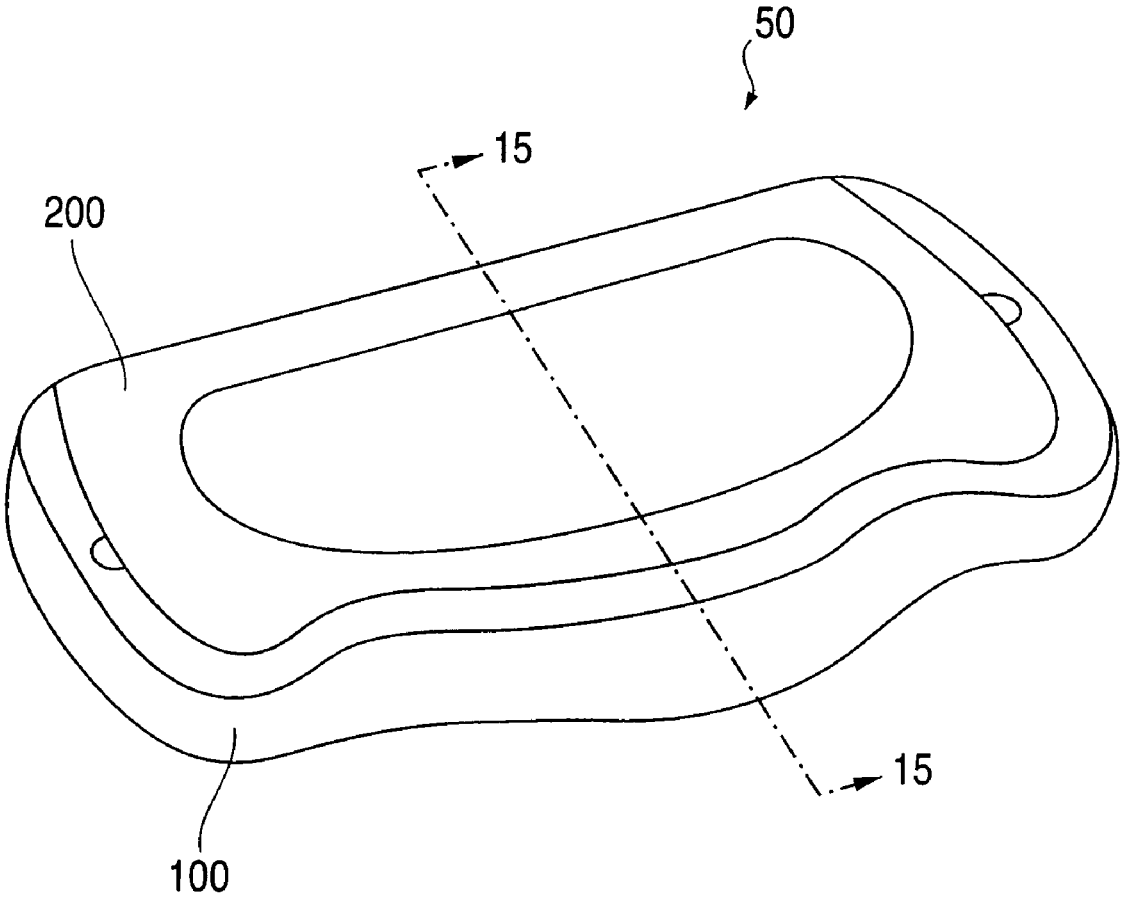
FIG. 13 is an assembled perspective view of an embodiment of a liner and a base tray according to the invention.

A further alternative embodiment of a tray insert according to the invention is illustrated in FIGS. 11 and 12. Tray insert 300 includes a rim 310 extending around a cavity 312. In this embodiment, the tray insert 300 includes an extending portion 330 and a flange 332. A recess 334 is formed in the bottom surface of the body portion of the tray insert 300. The recess 334 is defined at one end by a shoulder 336 that secures a coupler located on a base tray in the recess 334.

An embodiment of a tray set including a tray and a tray insert according to the invention is illustrated in FIGS. 13-17. FIGS. 14, 15, 16, and 17 illustrate embodiments of the operative engagement of the tray 100 and the tray insert 200.

Figure 14:
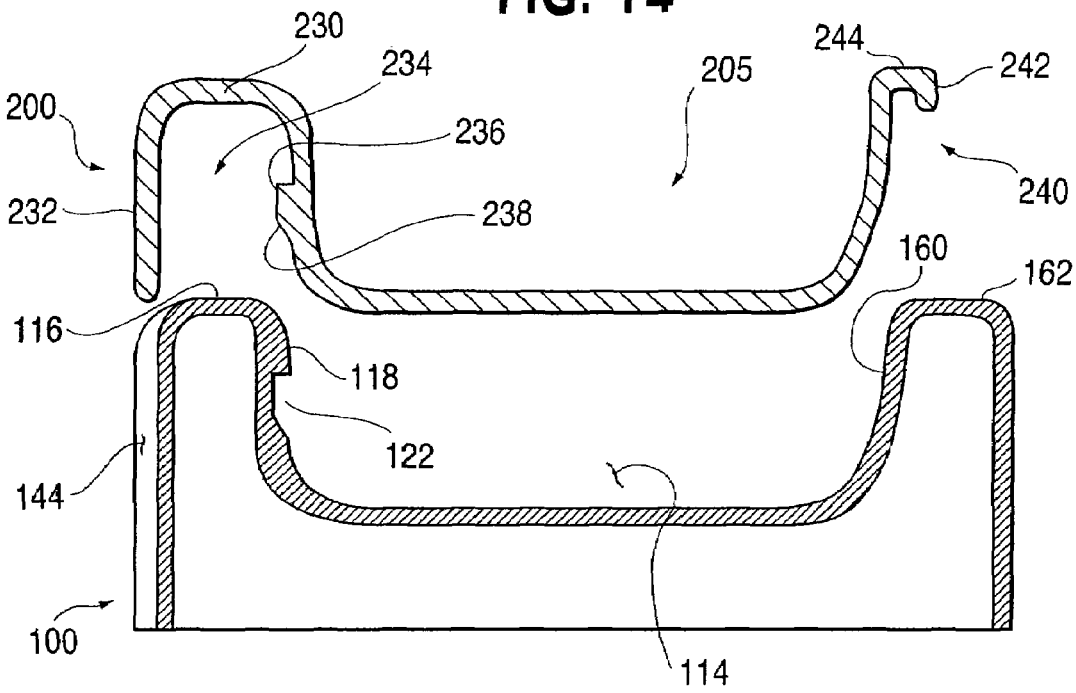
FIG. 14 is an exploded cross-sectional side view of the liner and base tray of FIG. 13.

In the illustrated embodiment, the tray set 50 includes a tray 100 and a tray insert 200. In operation, tray insert 200 is positioned above base tray 100 and the body portion 205 of the tray insert 200 is aligned with the cavity 114 of tray 100 as illustrated in FIG. 14. In this position, the cavity 234 on the tray insert 200 is aligned with the rear wall 116 of the base tray 100.

As the tray insert 200 is inserted into the cavity of tray 100, the inclined surface 238 of coupler 236 moves along the inner surface 118 of the rear wall 116. Once the tray insert 200 is advanced a sufficient distance, coupler 236 snaps into the recess 122. The mechanical engagement between the coupler 236 and the recess 122 releaseably engages tray insert 200 within the cavity of tray 100.

In order to release the coupler 236 from engagement with recess 122 and thereby release tray insert 200 from tray 100, a user places a finger into each recess 130 and 132 and pulls upwardly on tray insert 200. The upward movement causes coupler 236 to separate from the recess 122 allowing the user to remove tray 200 from the cavity 114. Any number of couplers, latches, or other connecting mechanisms and corresponding recesses can be used to couple the base tray 100 and the tray insert 200 together.

In one embodiment, as shown in FIG. 14, the tray insert 200 includes a seating portion 240 that has an outer surface 242 that is configured to conform to a portion of surface 160 of tray 100. The seating portion 240 extends along the front and sides of the tray insert 200. Upper surface 244 of mating portion 240 is level with the upper surface 162 of rim 110 when tray insert 200 is inserted into the cavity 114 of tray 100. Seating portion 240 provides a flush seating surface between tray insert 200 and tray 100 and prevents tray insert 200 from shifting within cavity 114.

Figure 15:
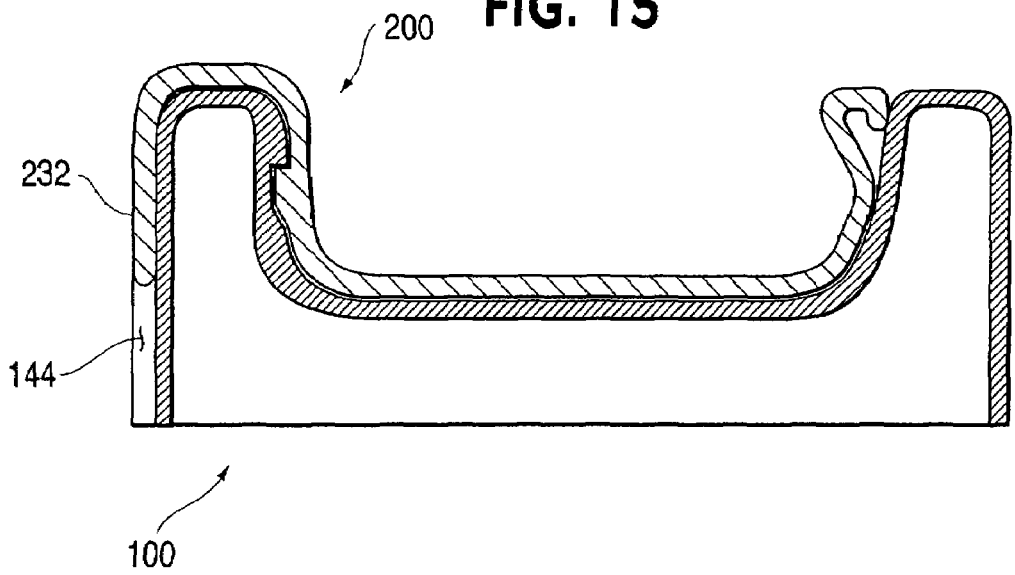
FIG. 15 is a cross-sectional side view of the liner and base tray of FIG. 13 taken along the lines "15-15" in FIG. 13.

In the illustrated embodiment, as illustrated in FIG. 15, flange 232 extends into channel 144 formed in tray 100 to prevent, for example, a small child from being able to easily remove tray insert 200 from a support, such as tray 100.

Figure 16:
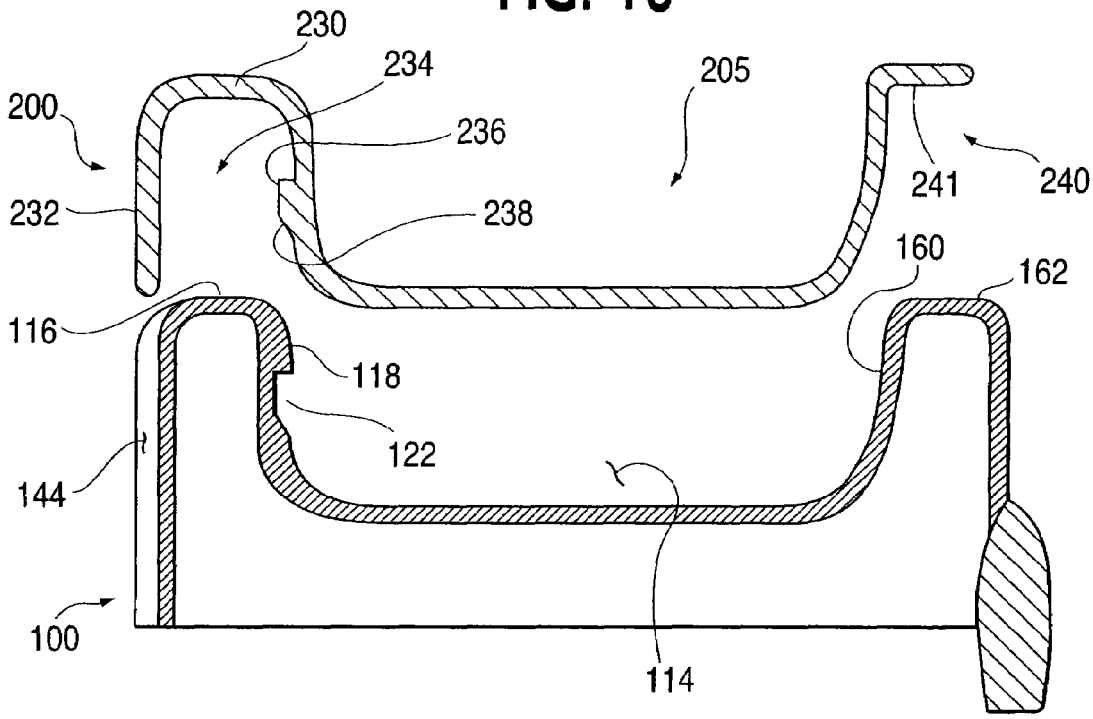
FIG. 16 is an exploded cross-sectional side view of an alternative embodiment of the liner and base tray.

In an alternative embodiment, as shown in FIG. 16, the tray insert 200 includes a seating portion 240 that has an inner surface 241 that is configured to conform to and engage a portion of surface 160, or more particularly, upper surface 162 of rim or ridge 110. The seating portion 240 extends along the front and sides of the tray insert 200 and overlays or overlaps the upper surface 162 of rim 110 when tray insert 200 is inserted into the cavity 114 of tray 100.

Figure 17:
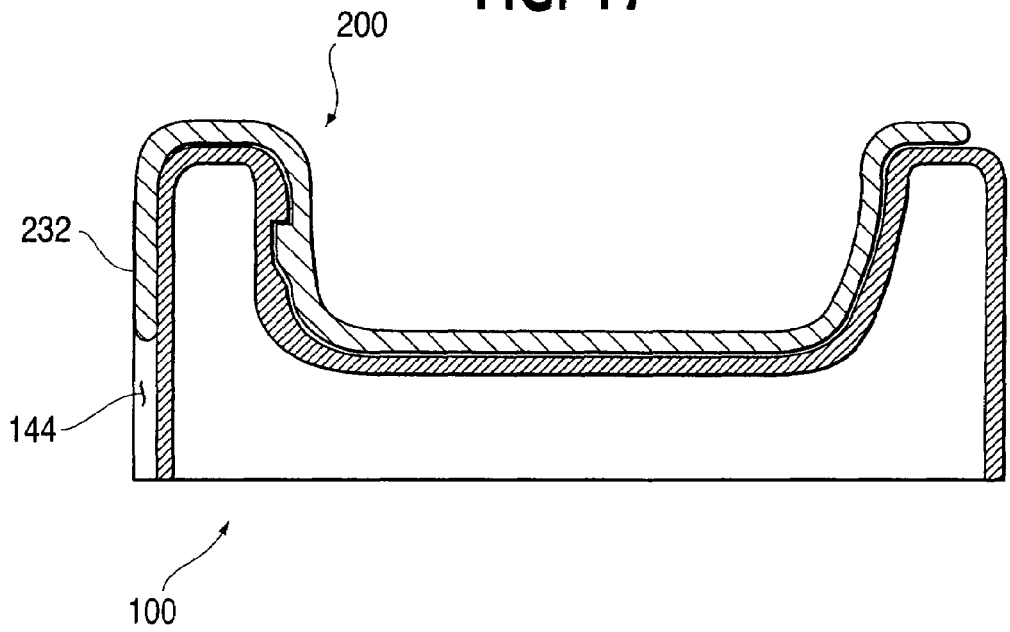
FIG. 17 is a cross-sectional side view of an alternative embodiment of the liner and base tray.

In the illustrated embodiment, as illustrated in FIG. 17, flange 232 extends into channel 144 formed in tray 100 to prevent, for example, a small child from being able to easily remove tray insert 200 from a support, such as tray 100.

Unless otherwise indicated herein, it is to be understood that the component parts of the invention are preferably made from a plastic material which can be molded and which is sufficiently durable and safe for use with infants and children of toddler age. Other materials, however, such as stainless steel, aluminum, and the like, could also be employed in the present invention.

Although the exemplary embodiments have been illustrated as a tray set including tray insert and tray combinations, various other configurations are possible and may include other structures, such as bed pans and bed pan liners, chair inserts, etc. Moreover, the tray insert and tray could contain various mechanical or electronic activity items embodied within or coupled to the tray insert or tray.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

The invention claimed is:

1. An insert removably disposable within a cavity of a support, the support including a rim defining a perimeter of the support and including a lower surface defining the cavity, the insert comprising:

a body portion including an upper surface having at least one pocket formed therein and a lower surface configured to be disposed adjacent the lower surface of the support;

a flange extending from a rear portion of the body portion substantially along a length of the rear portion of the body portion, the flange and the body portion defining a channel configured to receive a portion of the rim of the support; and a coupling member including a protrusion disposed on at least one of the flange and the rear portion of the body portion, the coupling member adapted to releasably and mechanically engage a recess formed in the rim of the support.

2. The insert of claim 1, wherein the flange is further configured to matingly engage a channel formed on an outer surface of the rim of the support.

3. The insert of claim 1, further comprising:

a seating portion extending from a forward portion of the body portion, the seating portion having a substantially horizontally extending flange configured to engage at least a portion of an upper surface of the rim of the support.

4. The insert of claim 1, further comprising:

a seating portion extending from a side portion of the body portion, the seating portion having a substantially horizontally extending flange configured to engage at least a portion of an upper surface of the rim of the support.

5. The insert of claim 1, further comprising:

a seating portion extending from at least a portion of the upper surface of the body portion, the seating portion having a substantially horizontally extending flange configured to engage at least a portion of an upper surface of the rim of the support.

6. The insert of claim 5, further comprising:

a seating portion extending from at least a portion of the upper surface of the body portion, the seating portion having a substantially horizontally extending flange configured to overlay at least a portion of an upper surface of the rim of the support.

7. The insert of claim 1, wherein the channel is substantially U-shaped.

8. A tray insert removably disposable within a cavity of a support, the cavity defined by a rim and a lower surface of the support, the rim defining a perimeter of the support, the support defining an indentation on an outer surface of the rim of the support and extending substantially along the length of at least one side of the support, the insert comprising:

a body portion including an upper surface having at least one pocket formed therein and a lower surface configured to be disposed adjacent the lower surface of the support;

an extending portion extending substantially along the length of at least one side of the body portion, the extending portion including a substantially downwardly extending flange, the flange and the body portion defining a channel configured to engage a portion of the rim of the support, the extending portion configured to matingly engage the indentation defined on the outer surface of the rim of the support; and a seating portion extending from at least a portion of an upper surface of the body portion, the seating portion having a substantially horizontally extending flange configured to engage in an overlying relationship with at least a portion of an upper surface of the rim of the support.

9. The tray insert of claim 8, wherein the seating portion extends from at least one of a forward portion of the body portion, a side portion of the body portion or a rear portion of the body portion.

10. A tray insert removably disposable within a cavity defined by a support, the support having a rim defining a perimeter of the support and a lower surface, the rim and the lower surface defining the cavity of the support, the tray insert comprising:

a body portion including an upper surface having at least one pocket formed therein and a lower surface configured to be disposed adjacent the lower surface of the support;

an extending portion extending from a rear portion of the body portion, the extending portion including a flange, the flange and the body portion defining a channel and being configured to engage a rear portion of the rim of the support; and a seating portion extending from at least a portion of an upper surface of the body portion, the seating portion having an upper surface and a substantially downwardly extending flange having an outer surface, the outer surface configured to conform to a portion of an inner surface of the rim of the support such that the upper surface of the seating portion is substantially flush with an upper surface of the rim of the support.

11. The tray insert of claim 10, wherein the seating portion extends from at least one of a forward portion of the body portion or a side portion of the body portion.

12. The tray insert of claim 10, wherein the extending portion is configured to matingly engage a channel defined on an outer surface of the rim of the support.

13. A tray insert removably disposable within a cavity of a support, the support including a rim and a lower surface defining the cavity, said tray insert comprising:

a body portion including a first surface having a pocket formed therein, a second surface adapted to be disposed adjacent said lower surface of the support, and an extending portion extending from a rear side of the body portion and configured to engage a channel defined on an outer surface of the rim of the support; and a coupling member including a protrusion disposed on said rear side of said body portion, said coupling member adapted to releasably and mechanically engage a recess formed in the support within the cavity of the support.

14. The tray insert of claim 13, wherein said coupling member is disposed on said second surface.

15. The tray insert of claim 13, wherein said extending portion of said body portion is a U-shaped extending portion.

* * * * *